United States Patent [19]

Day

[11] Patent Number: 4,651,987

[45] Date of Patent: Mar. 24, 1987

[54] EXERCISING DEVICE

[76] Inventor: Harold R. Day, 3093 Bradley Rd., Westlake, Ohio 44145

[21] Appl. No.: 533,422

[22] Filed: Sep. 19, 1983

[51] Int. Cl.[4] ..... A63B 21/04

[52] U.S. Cl. ..... 272/136; 272/DIG. 5; 272/68

[58] Field of Search ..... 273/1 G, 1 GC, 1 GH, 273/1 GI; 272/67, 135–143, 901, DIG. 5, 68, 126; 73/379–381

[56] References Cited

U.S. PATENT DOCUMENTS

| | | | |
|---|---|---|---|
| 911,925 | 2/1909 | Zeno | 272/901 |
| 2,782,033 | 2/1957 | Ugartechea | 272/901 |
| 2,806,699 | 9/1957 | Spooner | 272/DIG. 5 |
| 2,926,911 | 3/1960 | Reichel | 272/68 |
| 3,349,621 | 10/1967 | Mullen | 73/380 |
| 3,670,574 | 6/1972 | Edwards | 73/379 |
| 3,819,177 | 6/1974 | Spiro | 272/137 |
| 4,209,167 | 6/1980 | Jansen | 272/901 |
| 4,262,898 | 4/1981 | Lee | 272/68 |
| 4,427,194 | 1/1984 | Dion | 272/901 |
| 4,433,364 | 2/1984 | Noble | 272/68 X |

*Primary Examiner*—Richard J. Apley
*Assistant Examiner*—John L. Welsh

[57] ABSTRACT

A device for exercising muscles of the extremities is disclosed. The device consists generally of a spring, mounted on a base, with a free end upon which the arm or leg may bear to provide an opposing force. Indicia are provided on the spring to permit measurement of effort and achievement. In one embodiment of the invention, a counter is provided to enable the user to keep track of his efforts.

4 Claims, 2 Drawing Figures

EXERCISING DEVICE

BACKGROUND OF THE INVENTION

1. Field of the Invention

The present invention is in the field of amusement devices and games; more specifically, this invention is in the field of exercising devices.

2. Description of the Prior Art

There are many ways known for exercising muscles in the human body. The most obvious is that of whole-body exercise, such as jogging or distance running, swimming and competitive sports of many kinds. There are, however, cases where it is necessary or desirable to develop a specific set of muscles, such as, e.g., restoration of tone to an arm muscle after prolonged idleness. This could occur, for instance, where a fractured ulna requires a splint and immobilization of the arm. In such a case, whole-body exercise would probably not be the best way to improve the muscle tone in a single muscle or related set.

Devices are known which provide limited exercise for portions of the body. For instance, Rhodes shows an arm-wrestling device in U.S. Pat. No. 3,743,284, and Walls describes an apparatus for exercising various muscles in U.S. Pat. No. 4,328,964. The device of Walls comprises a series of elastic ropes and handles to provide countervailing tension which enables the user to put strain on his muscles. In the Walls device specifically, the user goes through the motions of swinging or throwing, the muscles being opposed by elastic ropes of the device.

SUMMARY OF THE INVENTION

The present invention comprises an exercising device having a base to which is affixed tension means, the tension means having affixed thereto a handle. In one embodiment of the device, a counter is included.

DESCRIPTION OF THE PREFERRED EMBODIMENTS

The preferred embodiment of the present invention comprises a portable device with a base having affixed thereto a tension means, the tension means having a handle affixed thereto. Means for securing the tension means juxtaposed adjacent the base are provided, and an event counter can be included. Indicia on the tension means permit use of the device as a competitive medium.

Figure 1:
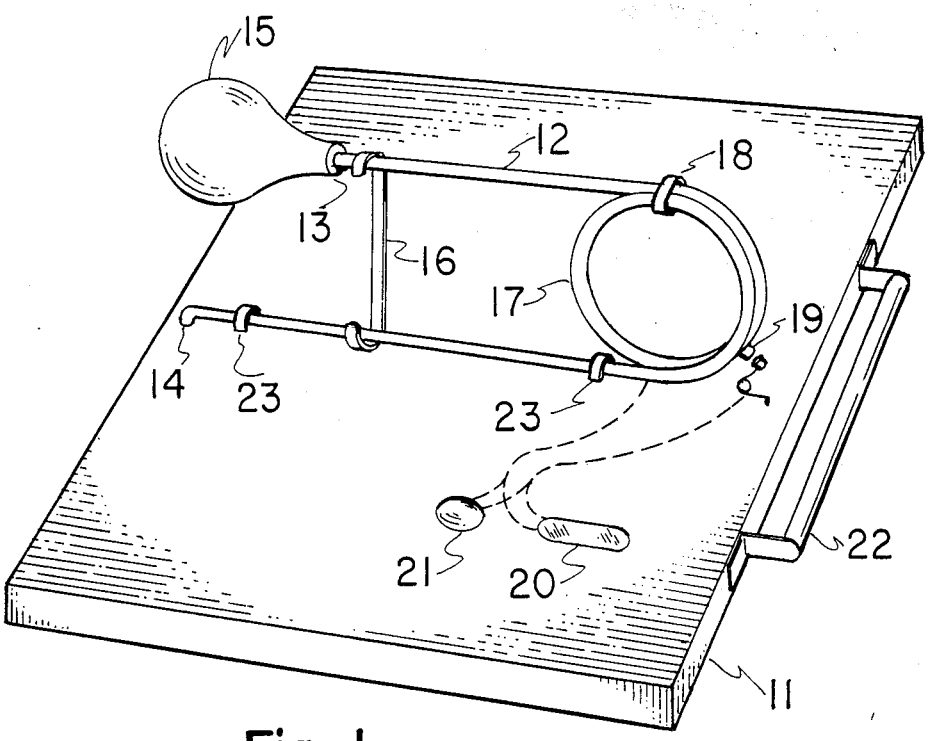
FIG. 1 is a view in perspective of the present invention.

Referring now to the drawings, FIG. 1 shows the device of the present invention in a perspective view. Base 11 is preferably formed of wood, plastic or other substance with relatively low weight and durability. Tension means 12 is shown here as a spring 12, being affixed at first end 13 to a handle 15. Handle 15 is preferably formed on a material such as wood, rubber or other material providing a secure grip for the hand, or comfortable and convenient gripping point or resting place for other body portions being exercised. Spring 12 is affixed by fastening means 23 at second end 14 and adjacent to, but not touching, coil 17, to base 11. Latch means 16 is used to secure spring 12 at second end 14 to base 11. Coil 17 is provided in the embodiment shown to permit a convenient spring length while maintaining a compact device for portability as discussed further hereinbelow. Coil 17 is also a safety consideration, permitting the spring to flex over a substantial portion of its length, thereby avoiding fatigue of the metal, or exceeding its elastic limit. Those skilled in the art will realize that other tension means are within the spirit and scope of this invention, and include, without limitation, fluid-damped piston-and-cylinder devices, electrical solenoid devices, and the like.

Figure 2:
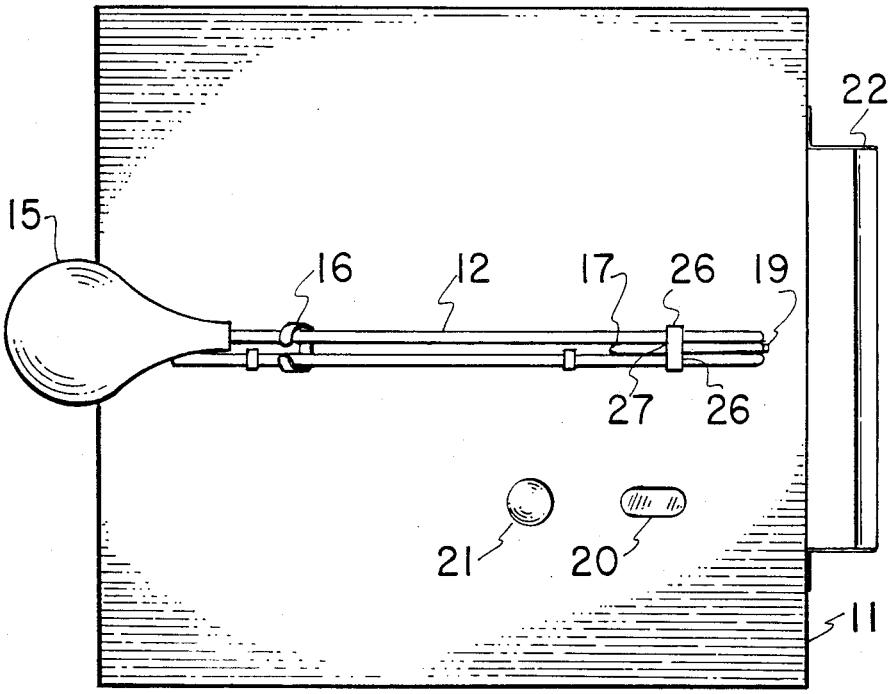
FIG. 2 is a plan view of the invention.

Indicia 18, shown also as lines 26 and 27 in FIG. 2, are provided to permit the calibration of individual effort, and to permit the device to be used in a competitive manner. Counter 19 is shown in FIG. 1 as a pair of contacts. Where such contacts are used, an electrical circuit 27 can be provided wherein each instance of contact causes display 20 to register and display a unitary event; contacts 19 can also comprise a mercury switch, closing a circuit when spring 12 is horizontal, and again at the vertical. The device could also be mechanical. Where the device is electrical, suitable power is provided, such as a battery or line cord for household current, neither of which is shown here. Counter 19 and the associated circuitry also provide a switching function for light 21, to indicate when spring 12 has been compressed or relaxed to a given extent. Such devices and power sources are well known to those skilled in the art, and are not further described herein. Display 20 and light 21 are set flush with the surface of board 11 for safety. Handle 22 is provided for ease of carrying when the device is transported.

While the dimensions of the device of the present invention are not critical, I have found that a convenient length of spring 12 between coil 17 and handle 15 is from about 30 to about 35 centimeters (cm), that distance being within the normal length of the forearm of the adult human, measured from the elbow to the palm. With this particular length, the device can be used as an opposing medium for development and exercise of the muscles of the upper arm and the shoulder.

While the device of the present invention could utilize a long spring to provide reasonable leverage commensurate with the tension required, I have found that it is adaptable to be transported by causing at least one, and preferably several, coils to be formed in spring 12. By so forming the spring, the net length is minimized, and the device can then be made readily portable. Handle 22 is provided for this purpose, and permits ready transportation of the device.

FIG. 2 shows the device of the present invention in a plan view. Latch means 16 holds spring 12 in the down position. In FIG. 2, indicia 18 are more readily seen, and are shown as lines 26 and 27 marked on spring 12 at coil 17; lines 26 on spring 12 are shown juxtaposed with lines 27 on coil 17.

In the operation of the device of the present invention, a person may simply depress the handle as rapidly and as often as appears necessary or desirable to effect the change or enhancement in the muscle affected. Counter 20 can be activated for the information of the user, or can be left off by means of appropriate switch means, not shown, but within the skill and knowledge of those skilled in the art. In order to be sure that the effort exerted is uniform, the user depresses handle 15 until light 21 flashes with spring 12 in the horizontal position, and again in the vertical position.

Another way of determining application of effort within standardized limits is the use of the indicia 18. On each horizontal placement of spring 12, the indicia can be observed; whether for individual effort or in competition, lines 26 should be made to coincide with lines 27.

As noted hereinabove, the present invention can also be used in a competitive fashion. For instance, a plurality of persons could each attempt to operate the device for a given length of time, the winner achieving the greatest number of cycles. Alternatively, the shortest time for a given number of operations would determine the winner, or the device could be used to test endurance, with the achievement of the greatest absolute number of strokes being the goal.

Those skilled in the art will realize that the present device can be used for exercising many different muscles of the body by adapting handle 15 as required. Specifically, handle 15 could be made as a yoke, to permit exercise of the neck muscles or a leg. In a similar fashion, handle 15 could be made as a stirrup for exercise of a foot or leg.

Latch means 16 can be of a type which secures spring 12 on engagement until released. This arrangement would permit a user to depress the spring until it was secured, without then having to consider the problem of the force of the spring on a return stroke. This aspect permits a weak muscle to be used until its power has been restored or enhanced.

Modifications, changes and improvements to the preferred forms of the invention herein disclosed, described and illustrated may occur to those skilled in the art who come to understand the principles and precepts thereof. Accordingly, the scope of the patent to be issued herein should not be limited to the particular embodiments of the invention set forth herein, but rather should be limited by the advance of which the invention has promoted the art.

I claim:

1. A portable exercising device comprising a base platform, a spring having a first end and a second end, said first end being affixed to said base, said second end having a handle affixed thereto, said spring having a coil intermediate said ends with indicia thereon for visual calibration of an individual's effort a counter affixed to said coil having a display device for counting and recording the number of times the spring has been compressed or relaxed to a given extent; and said base having a carrying handle affixed thereto.

2. The device of claim 1 wherein said counter is connected to an indicator.

3. The device of claim 1 wherein said handle is a yoke.

4. The device of claim 1 wherein said handle is a stirrup.

* * * * *